US007736240B2

(12) United States Patent
Chuang et al.

(10) Patent No.: US 7,736,240 B2
(45) Date of Patent: Jun. 15, 2010

(54) RODEO OR RIDING DEVICE

(76) Inventors: Jin Chen Chuang, No. 17, Lane 301, Nanyang Road, Fong Yuan, Taichung Hsien (TW) 42083; Lung Fei Chuang, No. 17, Lane 301, Nanyang Road, Fong Yuan, Taichung Hsien (TW) 42083

( * ) Notice: Subject to any disclaimer, the term of this patent is extended or adjusted under 35 U.S.C. 154(b) by 374 days.

(21) Appl. No.: 12/001,881

(22) Filed: Dec. 13, 2007

(65) Prior Publication Data

US 2009/0156320 A1 Jun. 18, 2009

(51) Int. Cl.
*A63G 17/00* (2006.01)
*A63G 31/06* (2006.01)

(52) U.S. Cl. ..... 472/97; 482/51; 434/247

(58) Field of Classification Search ..... 472/58, 472/59, 96–101, 108, 110, 135; 434/55, 434/62, 64, 65, 247, 365; 482/1–9, 51
See application file for complete search history.

(56) References Cited

U.S. PATENT DOCUMENTS 2,915,311 A * 12/1959 Delano ..... 472/97
3,997,979 A 12/1976 Turner ..... 35/29 R
4,470,373 A * 9/1984 Kesler ..... 119/427
5,085,425 A 2/1992 Collins et al. ..... 272/53.1
5,180,338 A * 1/1993 Pinto ..... 472/96
6,402,626 B1 6/2002 Beaty ..... 472/96
6,808,458 B1 * 10/2004 Jung ..... 472/97
6,866,594 B2 3/2005 Greenwood ..... 473/422
6,964,614 B1 * 11/2005 Tsai ..... 472/58
7,070,415 B2 * 7/2006 Hojo et al. ..... 434/247
7,104,927 B2 * 9/2006 Tsai ..... 482/51
7,121,831 B2 * 10/2006 Hojo et al. ..... 434/247
7,338,413 B2 * 3/2008 Nakanishi ..... 482/51
7,347,806 B2 * 3/2008 Nakano et al. ..... 482/51

* cited by examiner

*Primary Examiner*—Kien T Nguyen
(74) *Attorney, Agent, or Firm*—Charles E. Baxley

(57) ABSTRACT

A riding device includes one or more cranks rotatably attached to a base, and a rider support supported on a carrier and movable relative to the base for supporting a rider, and a moving device for moving the carrier and the rider support relative to the base in an elliptical and reciprocating action, the rider support may be moved in different moving strokes relative to the base and may be adjusted up and down relative to the carrier. The base includes a column having a pivotal arm coupled to the carrier with a link for allowing the carrier and the link to be moved up and down relative to the base and for allowing the carrier and the rider support to be moved in different elliptical and reciprocating actions by the crank.

12 Claims, 9 Drawing Sheets

RODEO OR RIDING DEVICE

BACKGROUND OF THE INVENTION

1. Field of the Invention

The present invention relates to a rodeo or riding device, and more particularly to a rodeo or riding device including a rider support or saddle supported on a carrier which is movable relative to a base by a drive mechanism or device in an elliptical and reciprocating action for allowing the rider support also to be moved relative to the base in the elliptical and reciprocating action.

2. Description of the Prior Art

Typical riding devices or rodeo training devices comprise a rider support for supporting the users thereon, and a drive mechanism having a crank arm coupled to the rider support to drive the rider support and to simulate the bucking and/or spinning motions of a rodeo animal attempting to unseat its rider.

For example, U.S. Pat. No. 3,997,979 to Turner discloses one of the typical rodeo training devices also comprising a drive mechanism coupled to the rider support with a crank arm for training cowboys to ride rodeo animals such as bulls and wild horses.

Normally, the drive mechanism is coupled to the rider support with the crank arm for actuating or moving or rotating the rider support. In addition, the drive mechanism is solidly coupled to the rider support with the crank arm, such that the rider support may not be moved relative to the crank arm and the drive mechanism in an elliptical and reciprocating action and also may not be moved relative to the crank arm and the drive mechanism in different moving stroke.

U.S. Pat. No. 5,085,425 to Collins et al. discloses a typical workout horse comprising a body portion having a support column extended downwardly therefrom, and an upper frame attached to the support column, and a drive mechanism coupled between the upper frame and a stationary base frame for actuating or moving the support column and the body portion relative to the stationary base frame.

However, the support column and the body portion may not be moved relative to the stationary base frame in an elliptical and reciprocating action. In addition, the drive mechanism is also solidly coupled between the upper frame and the stationary base frame such that the support column and the body portion also may not be moved relative to the stationary base frame in an elliptical and reciprocating action and also may not be moved relative to the stationary base frame in different moving stroke.

U.S. Pat. No. 6,402,626 to Beaty discloses a typical bucking machine also comprising a drive mechanism coupled to the rider support with one or more crank arms and/or links and/or spin wheels and/or spin shafts, and a rotating frame for supporting the rider support for allowing the rider support to be driven to simulate the bucking and/or spinning motions of a rodeo animal attempting to unseat its rider.

However, the rotating frame may only be rotated relative to the stationary base frame but not be moved relative to the stationary base frame in an elliptical and reciprocating action and also may not be moved relative to the stationary base frame in different moving stroke.

U.S. Pat. No. 6,866,594 to Greenwood discloses a typical polo training apparatus comprising a body portion having a lower frame portion, and a drive mechanism coupled between the lower frame portion of the body portion and a fixed frame for driving the lower frame portion of the body portion to simulate the polo training operation.

However, the fixed frame and the lower frame portion of the body portion may not be moved relative to the supporting ground or plane in an elliptical and reciprocating action and also may not be moved relative to the cranks and the swing arms of the drive mechanism in different moving stroke.

U.S. Pat. No. 6,964,614 to Tsai discloses a typical riding device also comprising a seat plate coupled to a front spindle and a rear spindle of a drive mechanism with cranks and swing arms respectively, for driving the seat plate to simulate the bucking and/or spinning motions of a rodeo animal attempting to unseat its rider.

However, the seat plate is also solidly coupled to the drive mechanism with the cranks and the swing arms, such that the seat plate may not be moved relative to the cranks and the swing arms of the drive mechanism in an elliptical and reciprocating action and also may not be moved relative to the cranks and the swing arms of the drive mechanism in different moving stroke.

The present invention has arisen to mitigate and/or obviate the afore-described disadvantages of the conventional bucking or riding or rodeo training devices.

SUMMARY OF THE INVENTION

The primary objective of the present invention is to provide a rodeo or riding device including a rider support or saddle supported on a carrier which is movable relative to a base by a drive mechanism or device in an elliptical and reciprocating action for allowing the rider support also to be moved relative to the base in the elliptical and reciprocating action.

The other objective of the present invention is to provide a rodeo or riding device including a rider support and/or a carrier movable relative to a drive mechanism or device for allowing the rider support to be moved in different moving strokes relative to the drive mechanism or device by the drive mechanism or device and by the moment of inertia.

The further objective of the present invention is to provide a rodeo or riding device including a rider support and/or a carrier movable up and down or along a curved moving path relative to the base for allowing the rider support to be moved in different moving strokes relative to the base.

In accordance with one aspect of the invention, there is provided a riding device comprising a base including a column extended therefrom, an arm pivotally coupled to the column of the base with a pivot pin, a carrier supported on the base and movable relative to the base, and including an end portion pivotally coupled to the arm with a link and a pivot pole which is spaced from the pivot pin for allowing the pivot pole and the link to be moved in a curved moving stroke around the pivot pin and to be moved up and down relative to the column of the base, a rider support supported on the carrier and moved in concert with each other for supporting a rider, and a moving device for moving the carrier and the rider support relative to the base in an elliptical and reciprocating action.

The base includes at least one crank rotatably attached to the base, and the carrier includes a curved member engaged with the crank for allowing the curved member of the carrier to be forced to move in the elliptical and reciprocating action by the crank.

The crank is coupled to the arm with an actuating lever for moving the arm in a reciprocating action relative to the column of the base. The actuating lever is coupled to the arm with a pivot rod which is spaced from the pivot pin and the pivot pole. The pivot pole is disposed between the pivot rod and the pivot pin.

The base includes a roller rotatably attached to the crank and engaged with the curved member of the carrier. The moving device includes a driving device coupled to the crank for rotating the crank relative to the base.

The driving device includes a fly wheel rotatably attached to the base and coupled to the crank and rotated in concert with the crank, a pulley rotatably attached to the base and coupled to the fly wheel, and a motor coupled to the pulley for rotating the pulley and the fly wheel and the crank relative to the base.

The rider support includes a post disposed on the carrier, a frame pivotally supported on the post with a pivot rod, and a saddle disposed on the frame. The post includes a beam disposed on the post, a hub disposed on the beam and pivotally coupled to the frame with the pivot rod.

The rider support includes at least one spring member engaged between the beam and the frame for cushioning the frame and the saddle. The rider support includes a fastener slidably engaged through the beam and the spring member and engaged with the frame for limiting the frame to tilt relative to the beam and the post.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
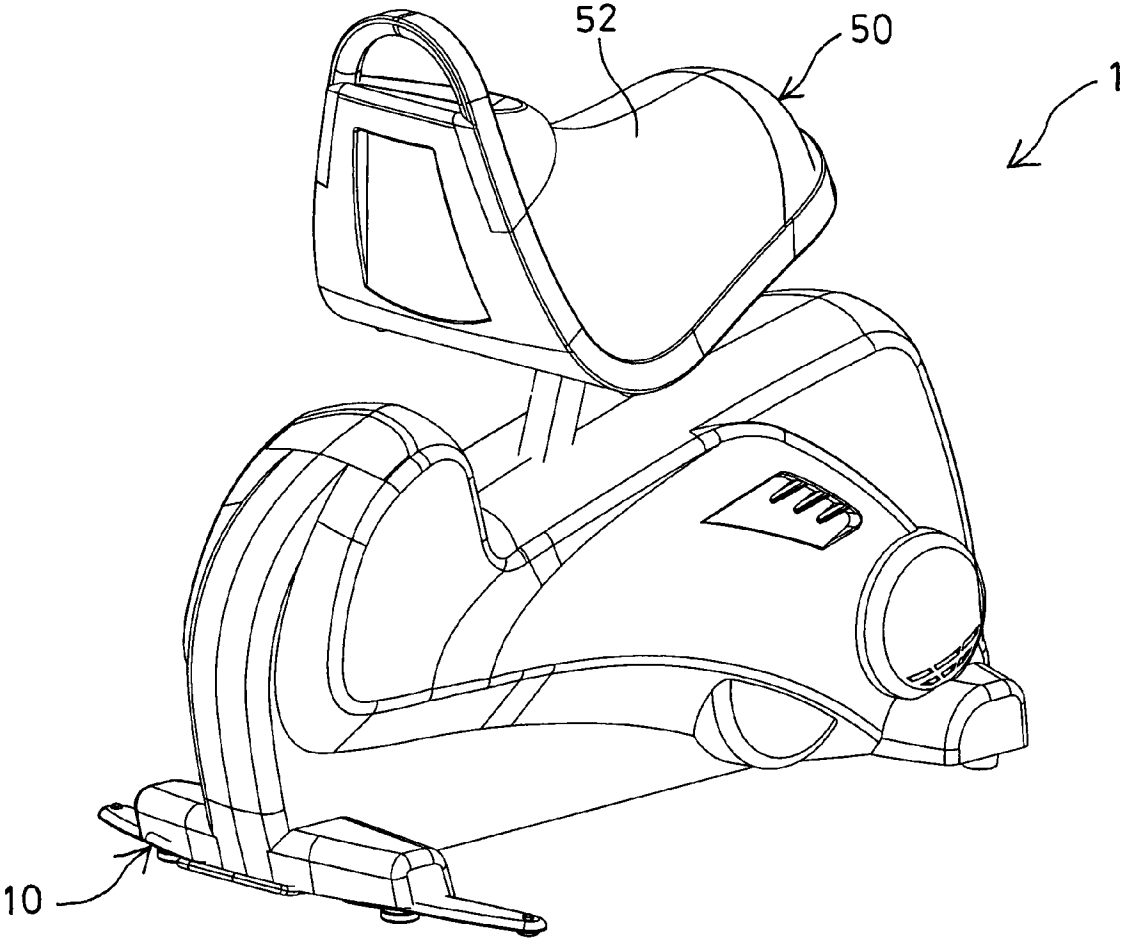
FIG. 1 is a front perspective view of a riding device in accordance with the present invention.
Figure 2:
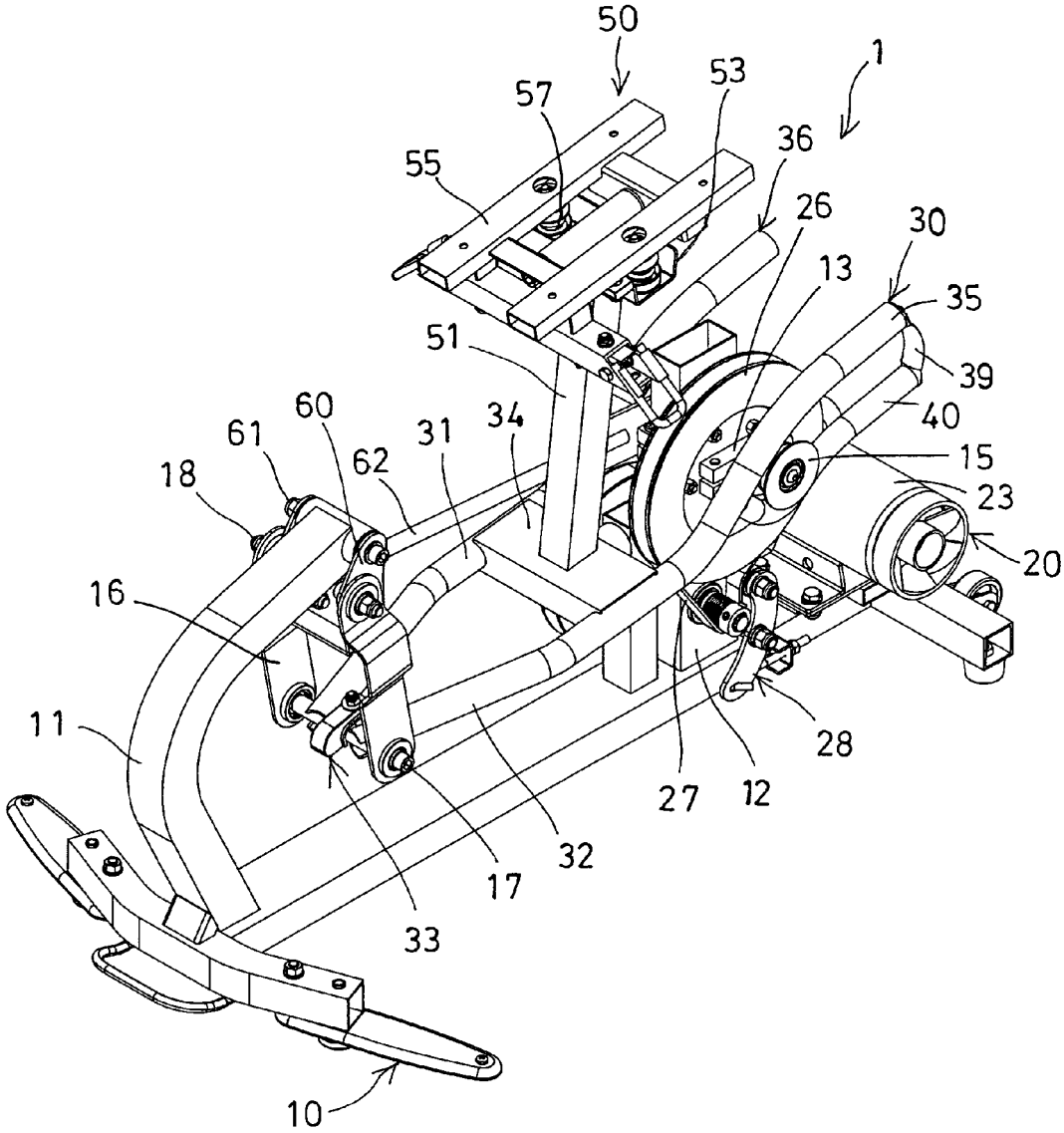
FIG. 2 is a front perspective view of the riding device, in which the outer covering and the saddle have been removed from the riding device.
Figure 3:
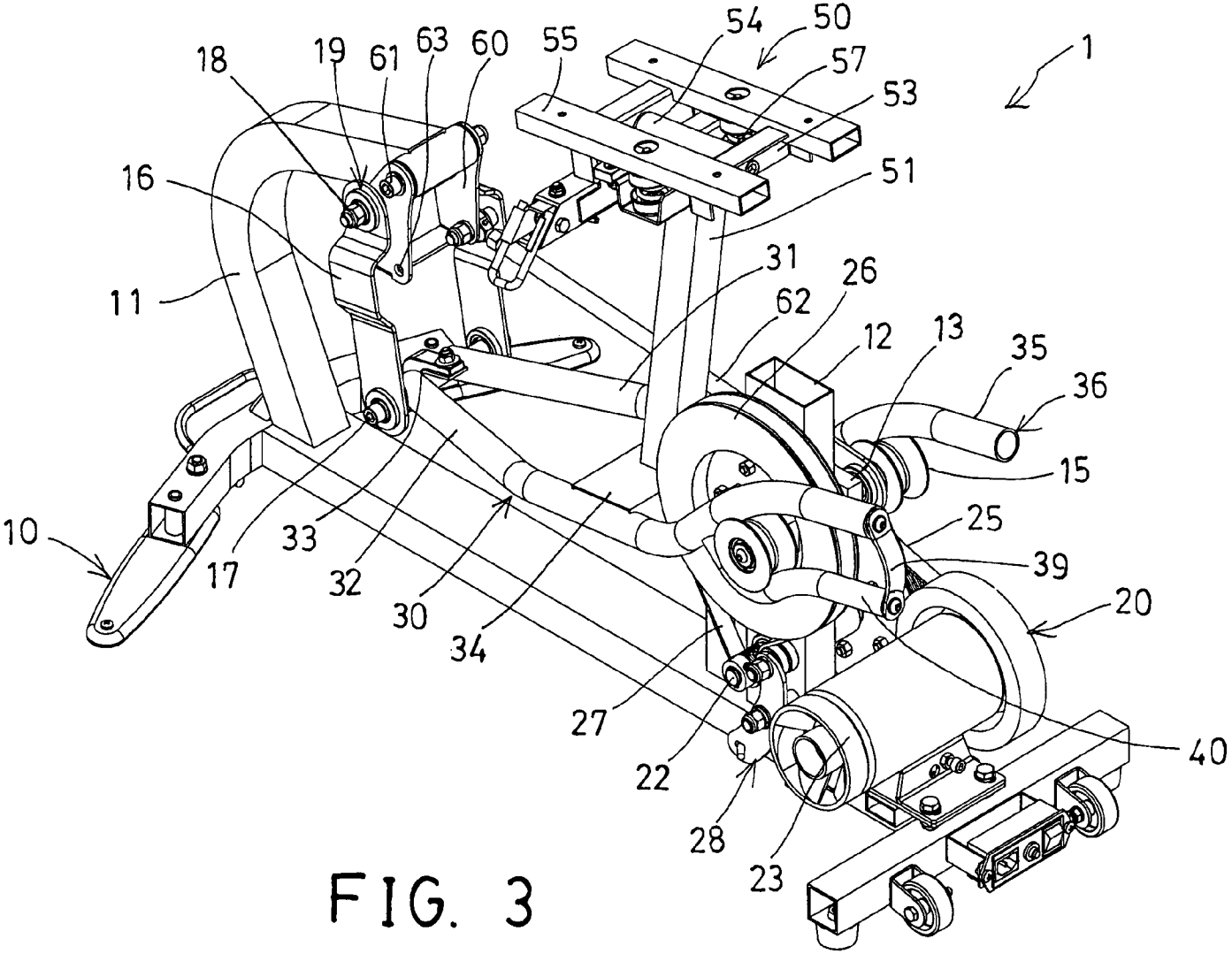
FIG. 3 is a rear perspective view of the riding device, in which the outer covering and the saddle have also been removed from the riding device.
Figure 4:
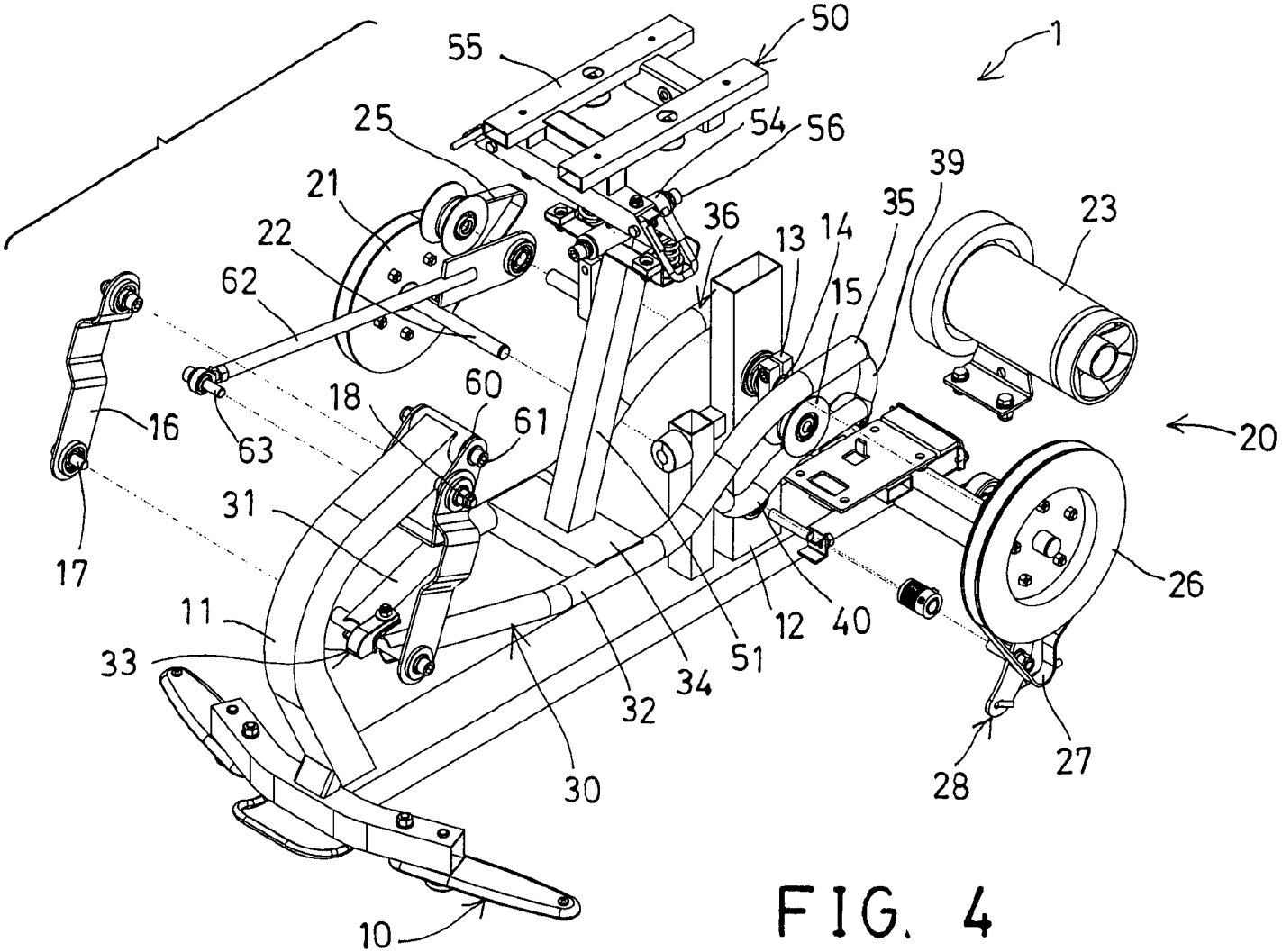
FIG. 4 is a partial exploded view as seen from the front portion of the riding device.
Figure 5:
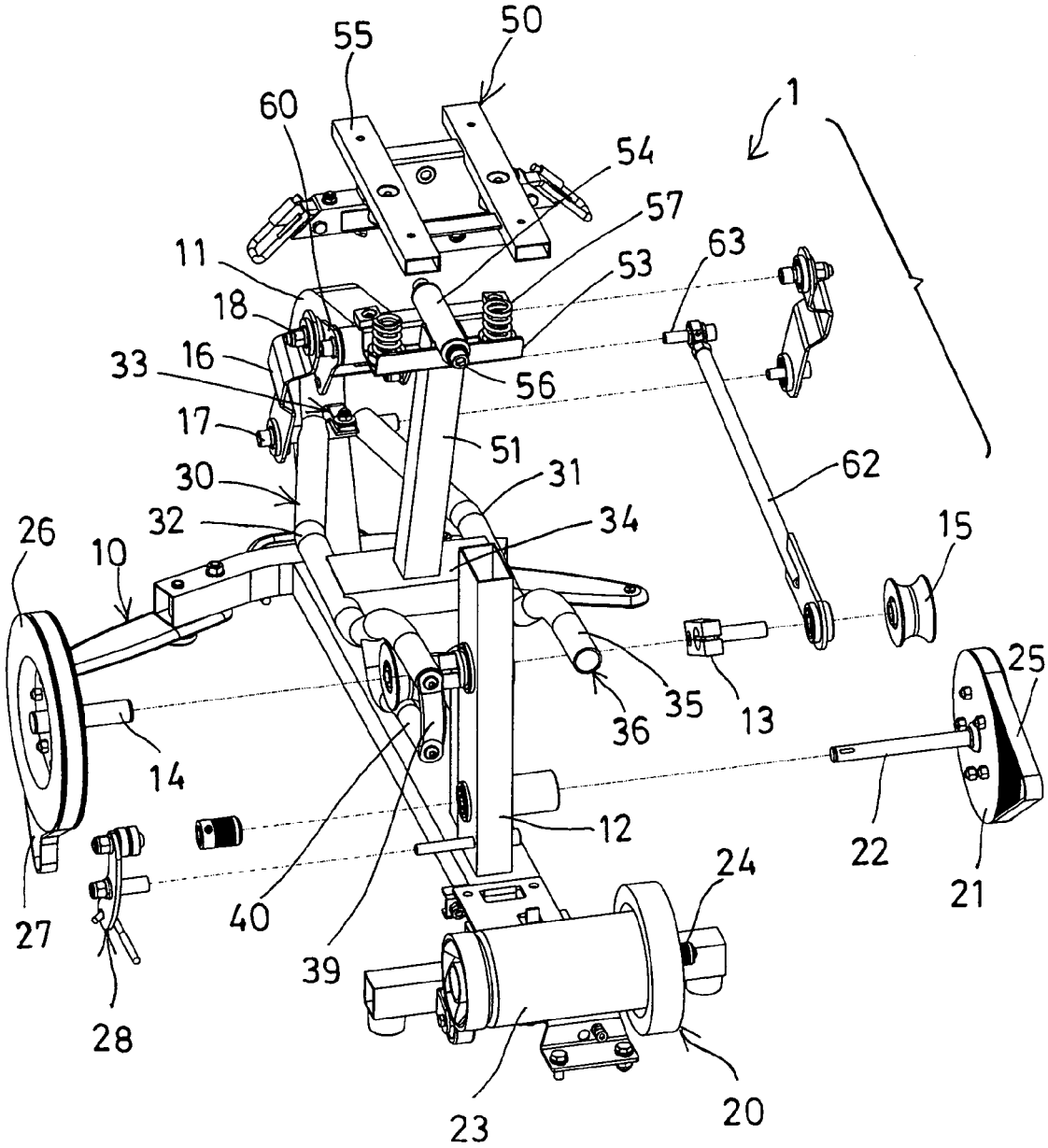
FIG. 5 is another partial exploded view as seen from the rear portion of the riding device.
Figure 6:
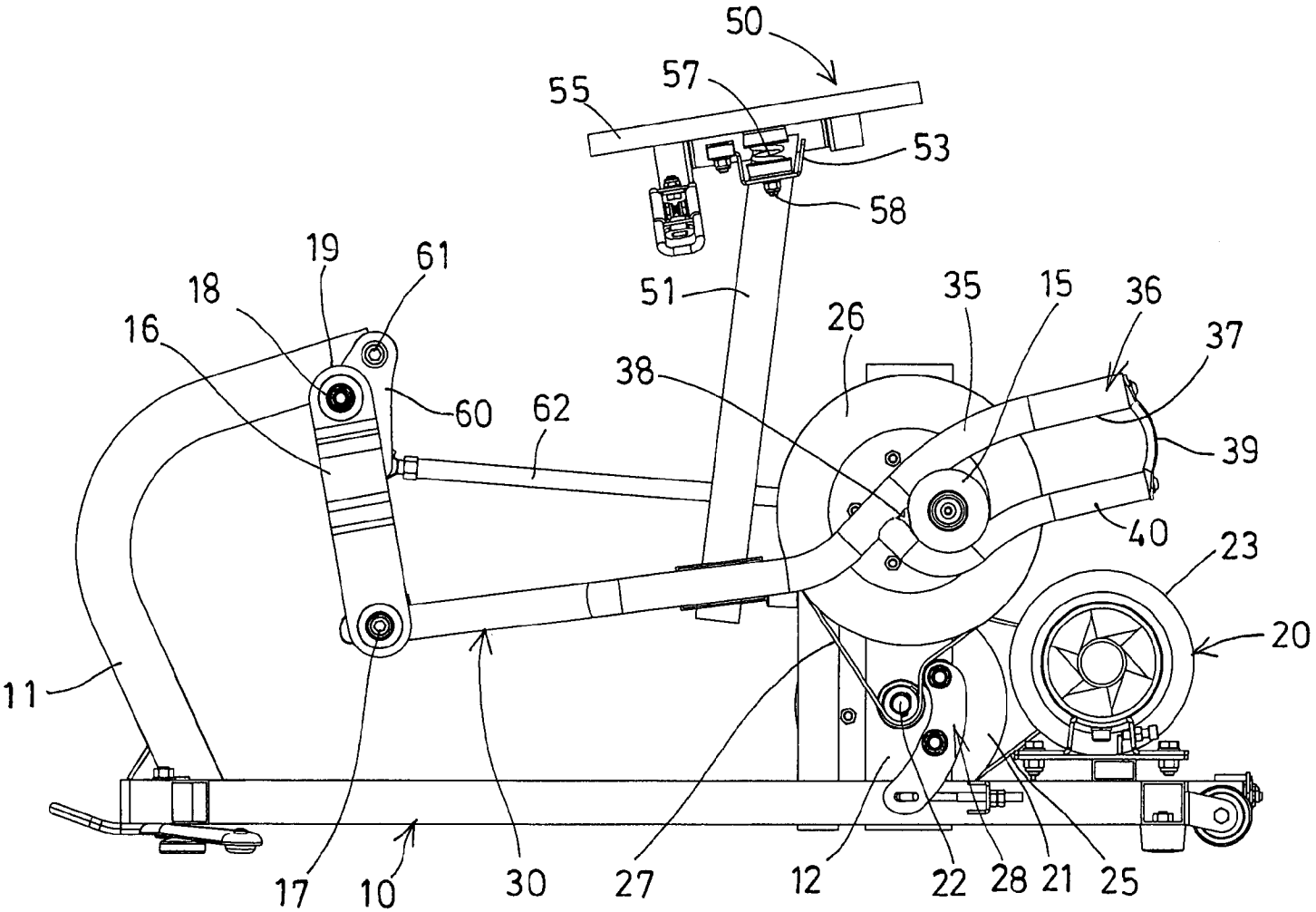
FIG. 6 is a side plan schematic view of the riding device.

Referring to the drawings, and initially to FIGS. 1-6, a riding device 1 in accordance with the present invention comprises a stationary base 10 including such as an I-shaped structure for increasing the stability of the base 10, and including a post or column 11 extended upwardly therefrom, such as extended upwardly from one end or the front portion of the base 10, and including a support or stud 12 extended upwardly therefrom, such as extended upwardly from the other end or the rear portion of the base 10, and including a crank device 13 or one or more (such as two) cranks 13 rotatably attached to or supported on the base 10, such as rotatably attached to the stud 12 with an axle 14 (FIGS. 4, 5) and thus rotatable relative to the base 10 in a cyclic and reciprocating action. A pulley or roller 15 is attached to the free end portion of each of the cranks 13.

A motor driving means or device 20 is disposed on the base 10 and is provided for coupling to the cranks 13 in order to rotate the cranks 13 relative to the base 10 in the cyclic and reciprocating action, and includes a wheel or pulley 21 rotatably attached to the base 10, such as rotatably attached to the stud 12 of the base 10 with a shaft 22, and includes a motor 23 disposed on the base 10 and having a spindle 24 (FIG. 5) coupled to the pulley 21 with a coupling device 25, such as a coupling belt 25, a gearing mechanism (not shown), a sprocket-and-chain mechanism (not shown) or the like for rotating or driving the pulley 21 relative to the base 10 or the stud 12, and includes a weight member or fly wheel 26 also rotatably attached to the base 10, such as rotatably attached to the stud 12 of the base 10 with the axle 14 for allowing the axle 14 and the cranks 13 and the fly wheel 26 to be rotated in concert with each other.

Figure 7:
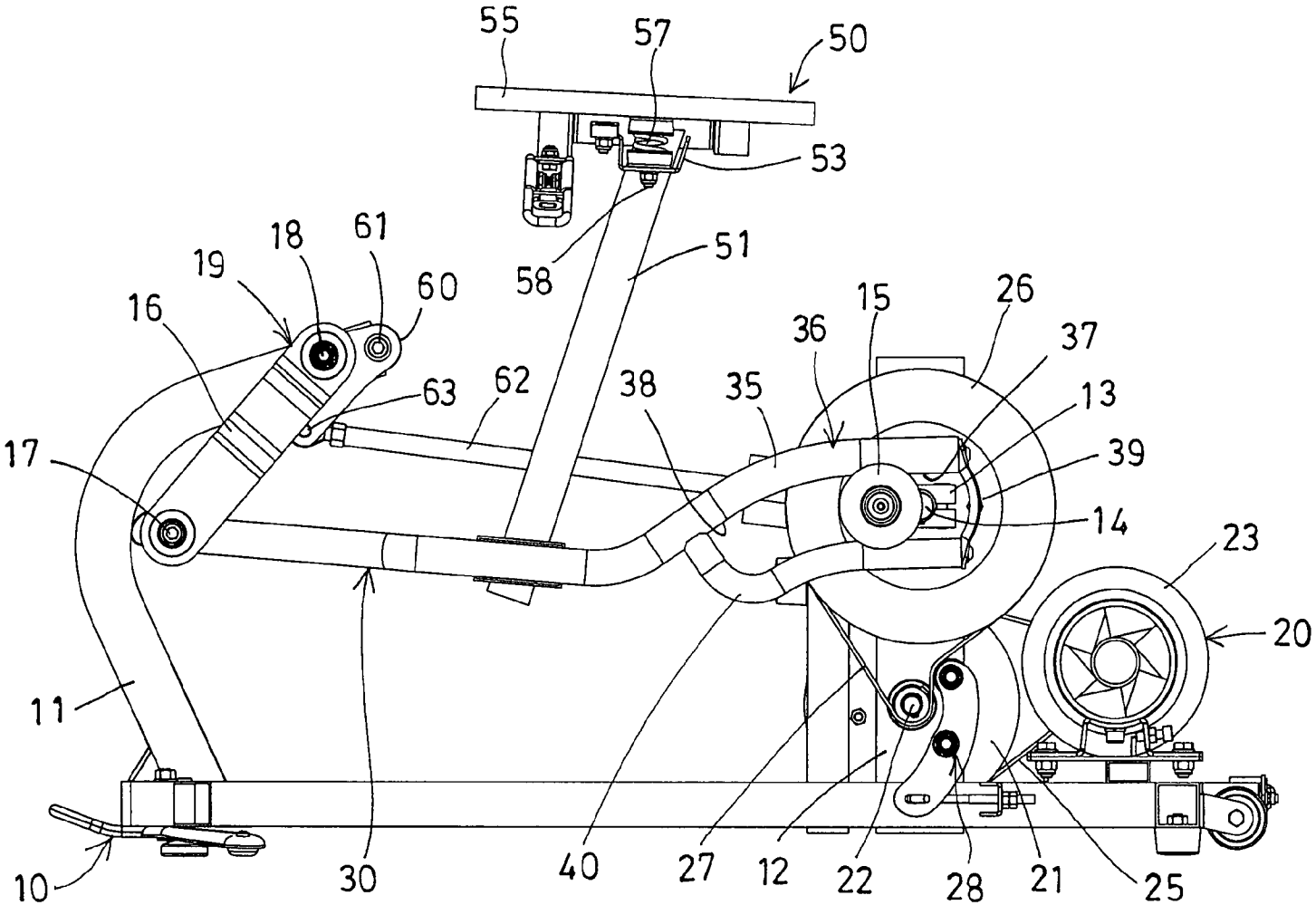
FIGS. 7, 8, 9, 10, 11 are side plan schematic views similar to FIG. 6, illustrating the operation of the riding device.
Figure 8:
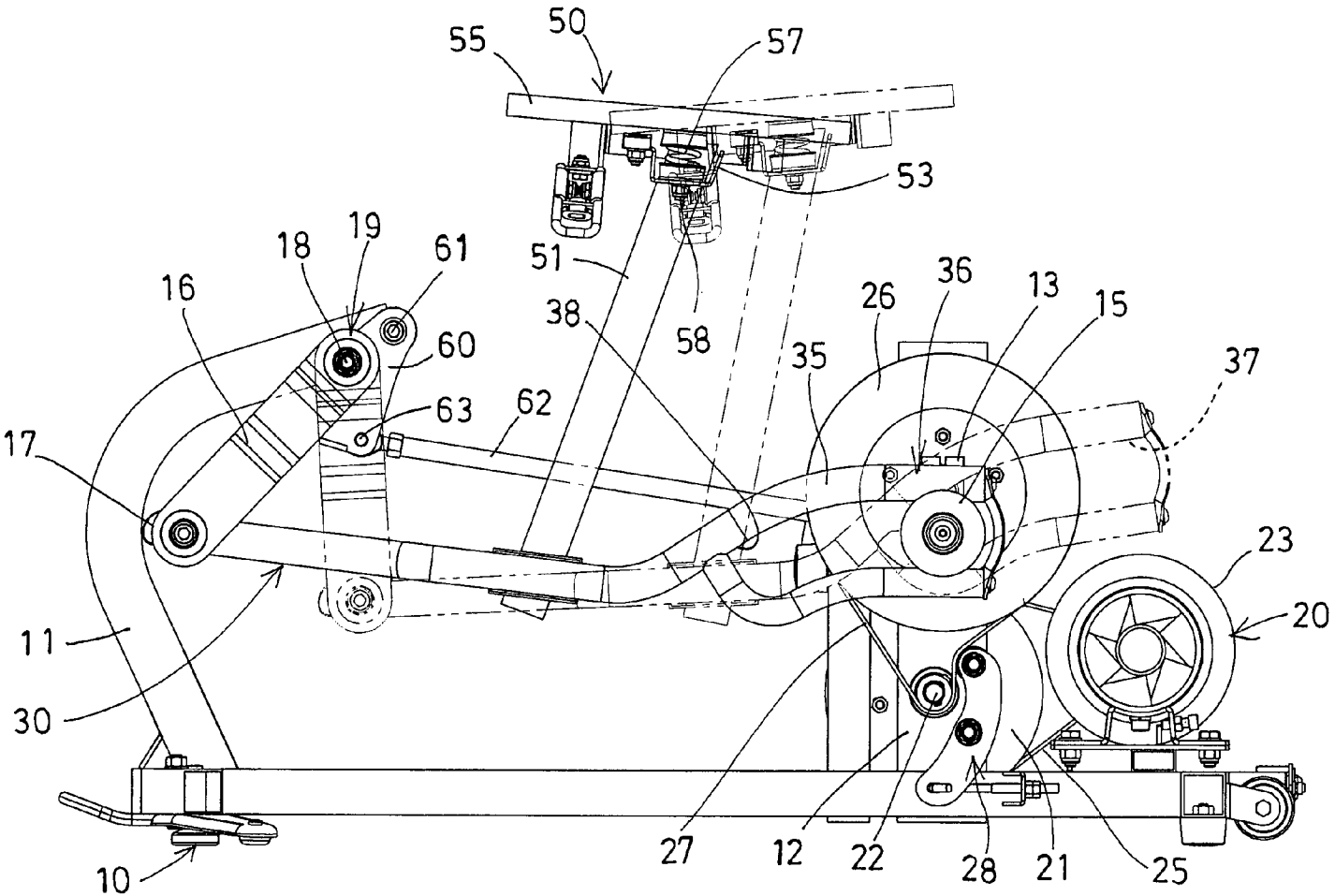
Figure 9:
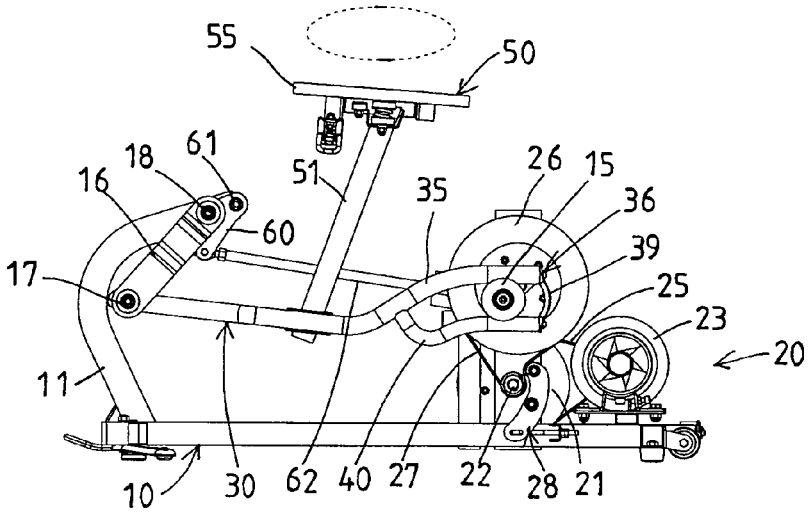
Figure 10:
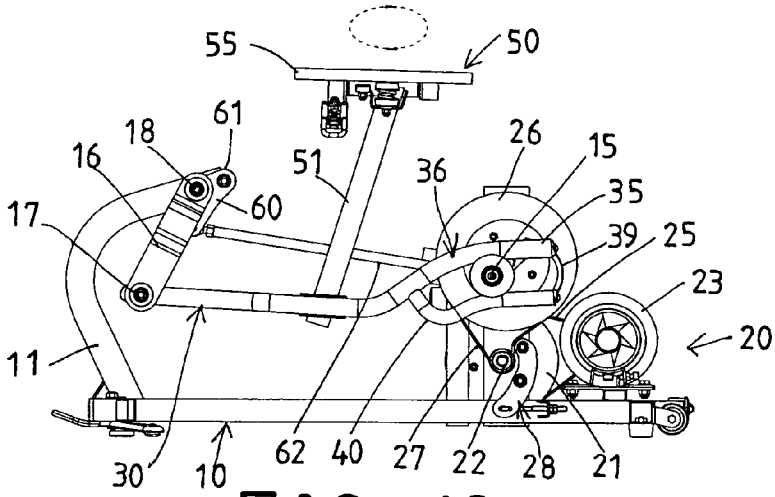
Figure 11:
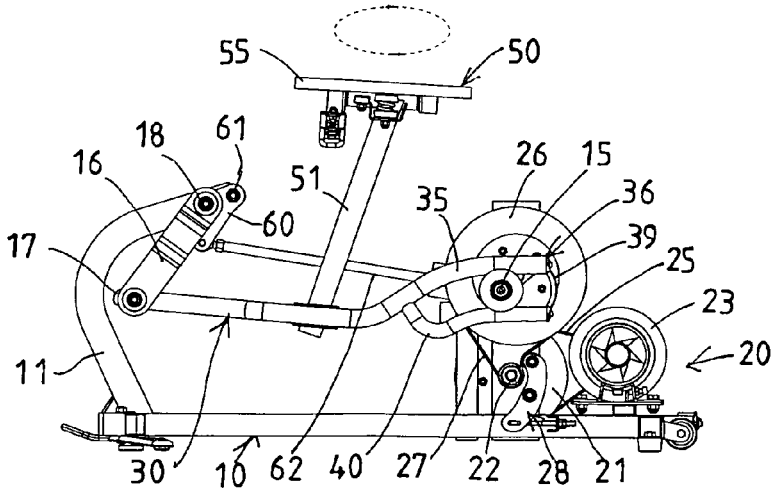

The weight member or fly wheel 26 is coupled to the pulley 21, such as coupled to the shaft 22 of the pulley 21 with another coupling device 27 (FIGS. 6-8), such as a coupling belt 27, a gearing mechanism (not shown), a sprocket-and-chain mechanism (not shown) or the like for allowing the pulley 21 to be indirectly coupled to the motor 23 with the pulley 21 and for allowing the pulley 21 and thus the cranks 13 to be driven or rotated relative to the base 10 or the stud 12 by the motor 23. The coupling the fly wheel 26 to the pulley 21 may thus be formed or acted as a speed reduction mechanism. Alternatively, the fly wheel 26 or the cranks 13 may also be directly coupled to the motor 23 with another coupling device (not shown) without the fly wheel 26 and the pulley 21. A brake device 28 may be provided and engaged with the coupling device 27 for braking the fly wheel 26 of the motor driving means or device 20.

A carrier 30 is to be supported on the base 10 and is to be moved relative to the base 10 in an elliptical and reciprocating action, and includes one or more (such as two) levers 31, 32 having one end or a front portion coupled together with a front coupling member 33 which is pivotally coupled to the base 10, such as pivotally coupled to the one end or the front portion or the front column 11 of the base 10 with a pivotal link 16 and a pivot pin 17 which is downwardly dependent on or from the front column 11 of the base 10 for allowing the one end or the front portion or the front coupling member 33 of the carrier 30 to be pivoted or rotated relative to the front column 11 of the base 10 and to be moved forwardly and rearwardly relative to the base 10 in a reciprocating action, best shown in FIGS. 6-11. It is preferable that the carrier 30 includes a bar 34 coupled between the middle portion of the levers 31, 32 for forming a stable or solid structure to the carrier 30 or for reinforcing the carrier 30.

The carrier 30 includes a curved segment or member 35 formed or provided on the rear end or the rear portion 36 of each of the levers 31, 32 and engaged onto the rollers 15 of the cranks 13 respectively, and the curved members 35 include a suitable curvature for slidably or movably engaging onto the rollers 15 of the cranks 13 and for allowing the curved members 35 to be forced and guided to move forwardly and rearwardly and upwardly and downwardly or cyclically relative to the base 10 by or with the cranks 13 and the motor 23 (FIGS. 6-11). It is to be noted that the curved members 35 each include an upwardly curved curvature having a top dead center portion 37 and a relatively lower portion 38 (FIGS. 6-8) for allowing the rollers 15 of the cranks 13 to have a tendency to be moved toward and retained on the top dead center portion 37 of the curved members 35.

The length of the levers 31, 32 are preferably predetermined and arranged for preventing the curved members 35 from being disengaged from the rollers 15 of the cranks 13 when the carrier 30 is moved forwardly and rearwardly relative to the base 10 in the reciprocating action (FIGS. 6-11). It is preferable that the carrier 30 further includes a positioning or stop member 39 attached or secured to the front and/or the rear portion of either or both of the curved members 35 for engaging with the rollers 15 of the cranks 13 and for limiting the movement of the levers 31, 32 or the carrier 30 relative to the rollers 15 of the cranks 13 and for preventing the levers 31, 32 or the carrier 30 from being disengaged from the rollers 15 of the cranks 13.

It is preferable that a retaining member 40 may further be provided and coupled or secured to either or both of the levers 31, 32 or the carrier 30, and secured to the stop member 39, and includes a suitable curvature similar or identical to that of the curved members 35 of the carrier 30, or the retaining member 40 is arranged parallel to the curved members 35 of the carrier 30 for further confining the rollers 15 of the cranks 13 between the retaining member 40 and the curved members 35 of the carrier 30 and in engagement with the curved members 35 of the levers 31, 32 or the carrier 30 and for preventing the levers 31, 32 or the carrier 30 from being disengaged from the rollers 15 of the cranks 13. In operation, as shown in FIGS. 6-11, the levers 31, 32 or the carrier 30 may thus be moved forwardly and rearwardly relative to the base 10 in the reciprocating action by or with the cranks 13 and the motor 23 and may be prevented from being disengaged from the rollers 15 of the cranks 13 inadvertently.

It is to be noted that the curved members 35 of the levers 31, 32 or the carrier 30 are not solidly or pivotally coupled to the cranks 13 such that the curved members 35 of the levers 31, 32 or the carrier 30 may be moved relative to the rollers 15 of the cranks 13, and such that the moving strokes of the curved members 35 of the levers 31, 32 or the carrier 30 relative to the rollers 15 of the cranks 13 may be different or changed when the curved members 35 of the levers 31, 32 or the carrier 30 are moved in different speeds relative to the rollers 15 of the cranks 13, as also best shown in FIGS. 6-11. The curved members 35 of the levers 31, 32 or the carrier 30 may also be caused to selectively move relative to the rollers 15 of the cranks 13 by the users themselves and by the moment of inertia when the users are stepped onto the carrier 30.

The carrier 30 is provided for supporting a rider support 50 thereon in order to support a user on the rider support 50, and the rider support 50 includes a post 51 disposed on the carrier 30, such as attached to or disposed on the bar 34 of the carrier 30 for supporting a seat cushion or saddle 52 thereon (FIG. 1) and for supporting a user thereon, in which the post 51 may include an adjustable or telescopic structure (not shown) for allowing the post 51 to be adjusted up and down to different length or height relative to the carrier 30. The adjustable or telescopic structure of the rider support 50 has been disclosed in a co-pending U.S. patent application Ser. No. 11/654,732, filed 17 Jan. 2007 which may be taken as a reference for the present invention.

The rider support 50 includes a beam 53 disposed on top of the post 51 (FIGS. 5-8) and preferably disposed parallel to the carrier 30 and/or the base 10, and includes a hub 54 disposed on the beam 53, such as disposed on the middle portion of the beam 53 (FIGS. 3, 5), and includes a frame 55 rotatably or pivotally coupled to the hub 54 of the beam 53 with such as a pivot rod 56 (FIGS. 4-5) for allowing the frame 55 of the rider support 50 to be rotated or pivoted or tilted or inclined relative to the beam 53 and the post 51. The seat cushion or saddle 52 is disposed or supported on the frame 55. Two spring members 57 are engaged with the frame 55 or engaged between the beam 53 and the frame 55 for cushioning the frame 55 and thus the saddle 52, and two fasteners 58 may be slidably engaged through the spring members 57 and threaded or engaged with the frame 55 for limiting the tilting or rotating movement of the frame 55 of the rider support 50 relative to the beam 53 and the post 51 or for preventing the rider support 50 from being over rotated relative to the beam 53 and the post 51.

In operation, as shown in FIGS. 6-11, the levers 31, 32 or the carrier 30 may be moved forwardly and rearwardly relative to the base 10 in the reciprocating action by the engagement of the curved members 35 of the levers 31, 32 or the carrier 30 with the rollers 15 of the cranks 13, and the one end or front portion or the front coupling member 33 of the carrier 30 is pivotally coupled to the base 10 with the pivotal link 16 and the pivot pin 17 such that the carrier 30 may be caused to move relative to the base 10 in an elliptical and reciprocating action by the cranks 13 and the motor 23. The cranks 13 and the motor 23 and/or the curved members 35 of the levers 31, 32 or the carrier 30 may thus be formed or acted as a moving means or device for moving the carrier 30 relative to the base 10 in the elliptical and reciprocating action. The typical riding devices or rodeo training devices failed to provide and dispose a saddle 52 or a rider support 50 on the carrier 30 for supporting the user, and a motor driving means or device 20 provided for moving the carrier 30 relative to the base 10 in an elliptical and reciprocating action.

The carrier 30 may be moved relative to the rollers 15 of the cranks 13 in different moving strokes relative to the base 10 because the curved members 35 of the levers 31, 32 or the carrier 30 are not solidly or pivotally coupled to the cranks 13 such that the curved members 35 of the levers 31, 32 or the carrier 30 may be moved relative to the rollers 15 of the cranks 13, and such that the moving strokes of the curved members 35 of the levers 31, 32 or the carrier 30 relative to the rollers 15 of the cranks 13 may be different or changed when the curved members 35 of the levers 31, 32 or the carrier 30 are moved in different speeds relative to the rollers 15 of the cranks 13. The curved members 35 of the levers 31, 32 or the carrier 30 may also be caused to selectively move relative to the rollers 15 of the cranks 13 by the users themselves and by the moment of inertia when the users are stepped onto the carrier 30 or applied a force onto the carrier 30.

The rider support 50 and thus the saddle 52 may be moved or adjusted up and down along the post 51 and relative to the carrier 30 according to the different heights of the users. The frame 55 and thus the saddle 52 may be suitably tilted or rotated relative to the beam 53 and the post 51 and cushioned by the spring members 57 for allowing the user to be comfortably supported on the rider support 50. The one end or front portion of the levers 31, 32 of the carrier 30 may also be slidably supported or coupled to the base 10 with such as rollers or wheels (not shown) instead of the pivotal link 16 and the pivot pin 17, the carrier 30 may also be caused to move relative to the base 10 in the elliptical and reciprocating action by the cranks 13 and the motor 23.

It is to be noted that the engagement of the curved members 35 of the levers 31, 32 or the carrier 30 with the rollers 15 of the cranks 13 may also be arranged or disposed on the front portion of the levers 31, 32 or the carrier 30 in order to move the rider support 50 and the carrier 30 relative to the base 10 in the elliptical and reciprocating action, and the rear portion of the levers 31, 32 or the carrier 30 may be pivotally coupled to the rear portion of the base 10 with the pivotal link 16 and the pivot pin 17 or slidably coupled to the base 10 with the rollers or wheels (not shown). The above-described structure has been disclosed and filed in the co-pending U.S. patent application Ser. No. 11/654,732, filed 17 Jan. 2007 which may be taken as a reference for the present invention.

An arm 60 is further provided and pivotally coupled to the one end or the front portion or the front column 11 of the base 10 with another pivot pin 61, and the pivotal link 16 has an upper portion 19 pivotally coupled to the arm 60 with a pivot pole 18 which is spaced from the pivot pin 61, and an actuating lever 62 coupled to one of the cranks 13 and coupled to the arm 60 with a pivot rod 63 which is spaced from the pivot pin 61 and the pivot pole 18, and the pivot pole 18 is preferably disposed between the pivot pin 61 and the pivot rod 63, such that the arm 60 may be forced or actuated to move in a reciprocating action relative to the front column 11 or the base 10 by the cranks 13, and the pivot pole 18 or the upper portion 19 of the pivotal link 16 may be forced or actuated to move in a curved moving stroke around the pivot pin 61 and thus may be forced or actuated to move up and down relative to the front column 11 or the base 10 for allowing the rider support 50 to be moved in a changing or increased or different moving strokes.

It is to be noted that the pivotal link 16 as disclosed in the co-pending U.S. patent application Ser. No. 11/654,732, filed 17 Jan. 2007 is pivotally coupled to the front column 11 of the base 10 and may only be swung relative to the front column 11 or the base 10, but may not be moved up and down relative to the front column 11 or the base 10. The pivotal coupling of the upper portion 19 of the pivotal link 16 to the arm 60 with the pivot pole 18 allows the pivot pole 18 or the upper portion 19 of the pivotal link 16 to be forced or actuated to move up and down relative to the front column 11 or the base 10 and allows the rider support 50 to be moved in the changing or increased or different moving strokes.

Accordingly, the riding device in accordance with the present invention includes a rider support movable relative to a drive mechanism or device for allowing the rider support to be selectively moved relative to the drive mechanism or device by the users themselves, and for allowing the rider support to be moved up and down relative to the supporting base and to be moved in different moving strokes relative to the drive mechanism or device by the drive mechanism or device and by the moment of inertia.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

We claim:

1. A riding device comprising:

a base including a column extended therefrom, an arm pivotally coupled to said column of said base with a pivot pin, a carrier supported on said base and movable relative to said base, and including an end portion pivotally coupled to said arm with a link and a pivot pole which is spaced from said pivot pin for allowing said pivot pole and said link to be moved in a curved moving stroke around said pivot pin and to be moved up and down relative to said column of said base, a rider support supported on said carrier and moved in concert with each other for supporting a rider, and means for moving said carrier and said rider support relative to said base in an elliptical and reciprocating action.

2. The riding device as claimed in claim 1, wherein said base includes at least one crank rotatably attached to said base, and said carrier includes a curved member engaged with said at least one crank for allowing said curved member of said carrier to be forced to move in the elliptical and reciprocating action by said at least one crank.

3. The riding device as claimed in claim 2, wherein said at least one crank is coupled to said arm with an actuating lever for moving said arm in a reciprocating action relative to said column of said base.

4. The riding device as claimed in claim 3, wherein said actuating lever is coupled to said arm with a pivot rod which is spaced from said pivot pin and said pivot pole.

5. The riding device as claimed in claim 4, wherein said pivot pole is disposed between said pivot rod and said pivot pin.

6. The riding device as claimed in claim 2, wherein said base includes a roller rotatably attached to said at least one crank and engaged with said curved member of said carrier.

7. The riding device as claimed in claim 2, wherein said moving means includes a driving device coupled to said at least one crank for rotating said at least one crank relative to said base.

8. The riding device as claimed in claim 7, wherein said driving device includes a fly wheel rotatably attached to said base and coupled to said at least one crank and rotated in concert with said at least one crank, a pulley rotatably attached to said base and coupled to said fly wheel, and a motor coupled to said pulley for rotating said pulley and said fly wheel and said at least one crank relative to said base.

9. The riding device as claimed in claim 1, wherein said rider support includes a post disposed on said carrier, a frame pivotally supported on said post with a pivot rod, and a saddle disposed on said frame.

10. The riding device as claimed in claim 9, wherein said post includes a beam disposed on said post, a hub disposed on said beam and pivotally coupled to said frame with said pivot rod.

11. The riding device as claimed in claim 10, wherein said rider support includes at least one spring member engaged between said beam and said frame for cushioning said frame and said saddle.

12. The riding device as claimed in claim 11, wherein said rider support includes a fastener slidably engaged through said beam and said at least one spring member and engaged with said frame for limiting said frame to tilt relative to said beam and said post.

* * * * *